US010770830B2

(12) United States Patent
Zhan

(10) Patent No.: US 10,770,830 B2
(45) Date of Patent: Sep. 8, 2020

(54) ELECTRONIC PRODUCT AND USB COVER CONNECTING STRUCTURE THEREOF

(71) Applicant: JRD Communication Inc., Shenzhen (CN)

(72) Inventor: Wangfa Zhan, Shenzhen (CN)

(73) Assignee: JRD Communication Inc., Shenzhen (CN)

( * ) Notice: Subject to any disclaimer, the term of this patent is extended or adjusted under 35 U.S.C. 154(b) by 0 days.

(21) Appl. No.: 16/478,139

(22) PCT Filed: May 27, 2017

(86) PCT No.: PCT/CN2017/086441
§ 371 (c)(1),
(2) Date: Jul. 16, 2019

(87) PCT Pub. No.: WO2018/129849
PCT Pub. Date: Jul. 19, 2018

(65) Prior Publication Data

US 2019/0372267 A1 Dec. 5, 2019

(30) Foreign Application Priority Data

Jan. 16, 2017 (CN) ..... 2017 1 0030649

(51) Int. Cl.
*H01R 13/52* (2006.01)

(52) U.S. Cl.
CPC ..... *H01R 13/5213* (2013.01)

(58) Field of Classification Search
CPC ... H01R 13/443; H01R 13/44; H01R 13/5213
(Continued)

(56) References Cited

U.S. PATENT DOCUMENTS 5,125,852 A * 6/1992 Archer ..... H01R 13/74 439/135
5,681,174 A * 10/1997 Correll, Jr. ..... H01R 43/205 439/135

(Continued)

FOREIGN PATENT DOCUMENTS

CN 101908689 12/2010
CN 202178450 3/2012

(Continued)

OTHER PUBLICATIONS

International Search Report and the Written Opinion dated Oct. 18, 2017 From the International Searching Authority Re. Application No. PCT/CN2017/086441 and Its Translation of Search Report Into English. (9 Pages).

*Primary Examiner* — Gary F Paumen

(57) ABSTRACT

A universal serial bus (USB) cover connecting structure of an electronic product is provided, including a USB cover, covering a USB port of the electronic product, and disposed on a case of the electronic product. A first extending part and a second extending part are disposed on opposite ends of the USB cover, and a first gap and a second gap are formed between the first extending part, the second extending part, and sidewalls of the USB cover, so that while one of first and second extending parts is pressed, the other one of the first and second extending parts will be lifted, thereby forming a digging position for a finger to easily pull the USB cover out. Costs of molds and production are reduced due to removal of a groove.

18 Claims, 3 Drawing Sheets

(58) Field of Classification Search
USPC ..... 439/135, 148, 149, 940
See application file for complete search history.

(56) References Cited

U.S. PATENT DOCUMENTS

| | | | | |
|---|---|---|---|---|
| 6,991,490 | B1 | 1/2006 | Su | |
| 7,004,768 | B2 * | 2/2006 | Ma | H05K 7/1061 439/135 |
| 7,140,890 | B1 * | 11/2006 | Ju | H01R 43/205 439/135 |
| 7,527,507 | B2 * | 5/2009 | Liao | H01R 13/447 439/135 |
| 7,866,985 | B2 * | 1/2011 | Hsu | H05K 7/1061 439/41 |
| 8,199,464 | B2 | 6/2012 | Zuo et al. | |
| 9,083,109 | B2 | 7/2015 | Tetsuya | |
| 2010/0309613 | A1 | 12/2010 | Zuo et al. | |
| 2014/0080334 | A1 | 3/2014 | Tetsuya | |

FOREIGN PATENT DOCUMENTS

| | | |
|---|---|---|
| CN | 203574161 | 4/2014 |
| CN | 203734014 | 7/2014 |
| CN | 204289873 | 4/2015 |
| CN | 205039326 | 2/2016 |
| JP | 2000-323225 | 11/2000 |
| WO | WO 2018/129849 | 7/2018 |

* cited by examiner

ELECTRONIC PRODUCT AND USB COVER CONNECTING STRUCTURE THEREOF

RELATED APPLICATIONS

This application is a National Phase of PCT Patent Application No. PCT/CN2017/086441 having International filing date of May 27, 2017, which claims the benefit of priority of Chinese Patent Application No. 201710030649.1 filed on Jan. 16, 2017. The contents of the above applications are all incorporated by reference as if fully set forth herein in their entirety.

FIELD AND BACKGROUND OF THE INVENTION

The invention relates to electronic products, and more particularly, to an electronic product and a universal serial bus (USB) cover connecting structure of an electronic product and electronic products.

With increase of the variety of electronic products, all of them are provided with a universal serial bus (USB) port for charging or communicating with a computer. For dust-proof and water-proof purposes, USB covers are disposed over existing USB ports s to provide shielding and sealing, thereby preventing malfunction of the electronic products caused by dusts and water entering the USB ports. Based on some researches, it is found that a groove is disposed next to the USB port of the electronic products to form a digging position, so that the USB cover can be easily removed for charging and the like. Because the groove needs to be placed next to the USB port, not only the cost in manufacturing molds increases, but also product appearance is affected.

SUMMARY OF THE INVENTION

In order to overcome the deficiencies of the prior art, the present invention provides a universal serial bus (USB) cover connecting structure of an electronic product, so that it is convenient to open the USB cover without providing a groove beside a USB port, and the fabrication cost can be thus reduced.

The present invention provides a USB cover connecting structure of an electronic product, comprising a USB cover, covering a USB port of an electronic product, and disposed on a case of the electronic product. A first extending part and a second extending part are disposed on opposite ends of the USB cover, and a first gap and a second gap are formed between the first extending part, the second extending part, and sidewalls of the USB cover.

Moreover, the USB cover comprises the insertion part for inserting into the USB port and an exterior cover exposed above the case, and the first extending part and the second extending part are disposed on the exterior cover.

Moreover, a groove is disposed on a side of the exterior cover opposite to the insertion part, and a side of the insertion part opposite to the exterior cover is inserted into the groove to tightly fit the groove.

Moreover, a USB hole is disposed on the USB port of the case, and the USB hole is provided with a protrusion having an annular shape, and a width of the protrusion on one side of the first extending part is greater than a width of the protrusion on the other side, and an end of the USB cover opposite to the protrusion abuts against the protrusion, so that a space is formed between the first gap, the second gap and the protrusion.

Moreover, a columnar connection rod extending along a direction toward the protrusion is disposed on a side of the insertion part opposite to the first extending part, and a socket is disposed on the protrusion at a position opposite to the columnar connection rod, and the columnar connection rod inserts into the socket.

Moreover, a position limiting block with a diameter greater than the socket is disposed on the columnar connection rod.

Moreover, the USB cover further comprises a connecting part for inserting into the groove provided between the insertion part and the exterior cover, and the connecting part extends towards the first extending part to secure with the columnar connection rod, and the insertion part is secured with the connecting portion.

Moreover, the USB cover is made of a soft material.

The present invention also provides an electronic product comprising the USB cover connecting structure of the electronic product.

Compared with the prior art, the present invention forms a gap between the extending parts and sidewalls of the USB cover by disposing an extending part on opposite sides of the USB cover, so that while one of extending part is pressed and the other one will be lifted, thereby forming a digging position for a finger to pull the USB cover out easily. Costs of the mold and the production cost are reduced due to removal of the groove.

DESCRIPTION OF SPECIFIC EMBODIMENTS OF THE INVENTION

The present invention will be further described in detail below with reference to the accompanying drawings and embodiments.

Figure 1:
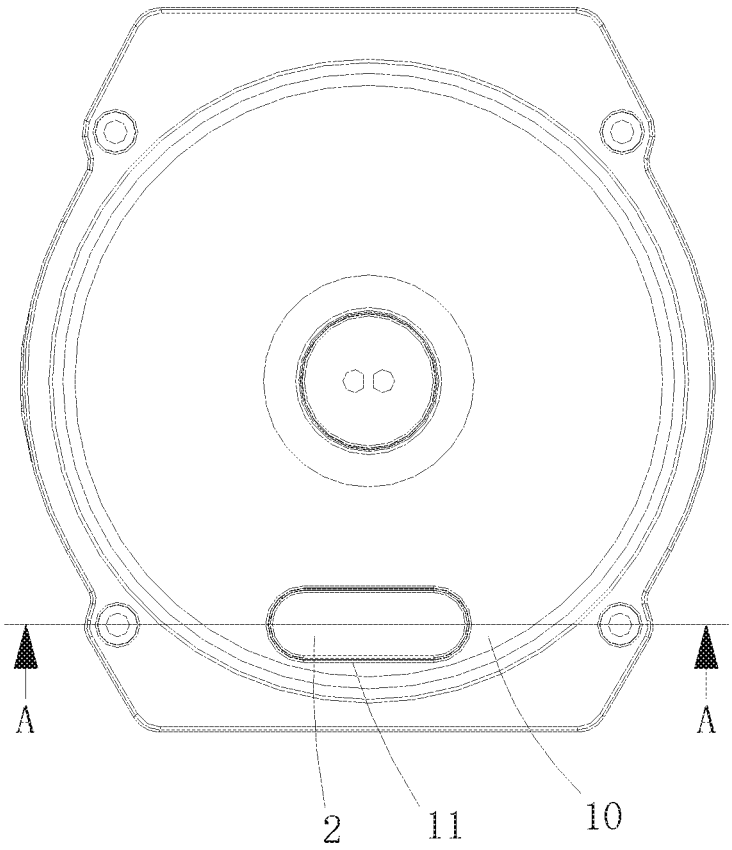
FIG. 1 is a schematic view of an external structure of the present invention.
Figure 2:
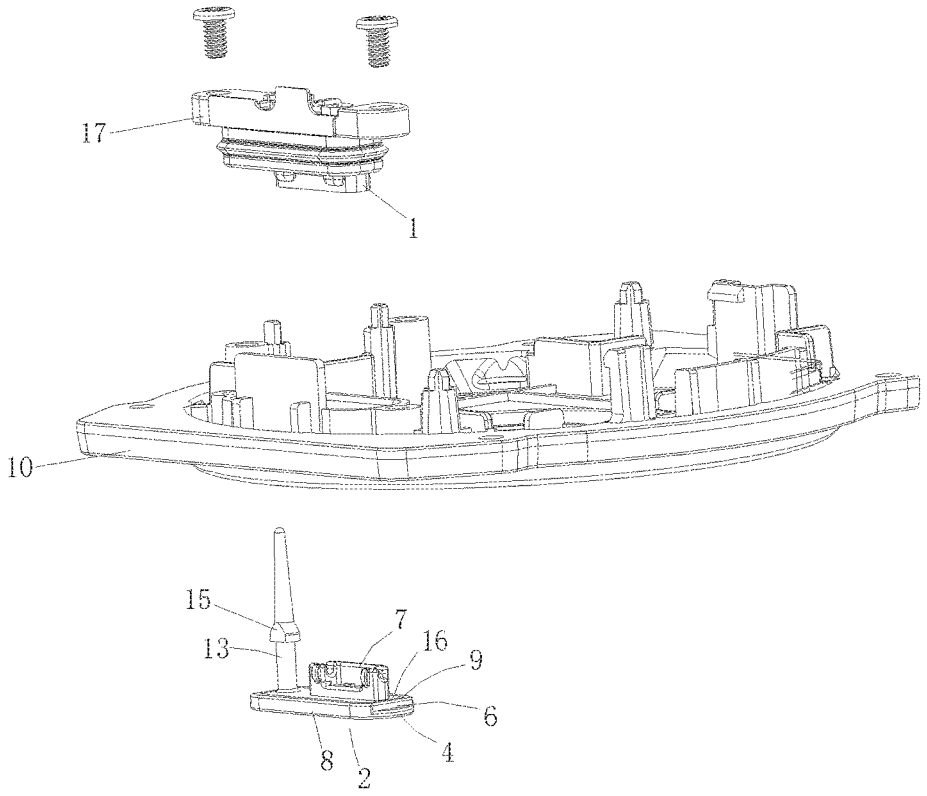
FIG. 2 is a schematic view of a stereoscopic explosion structure of the present invention.
Figure 3:
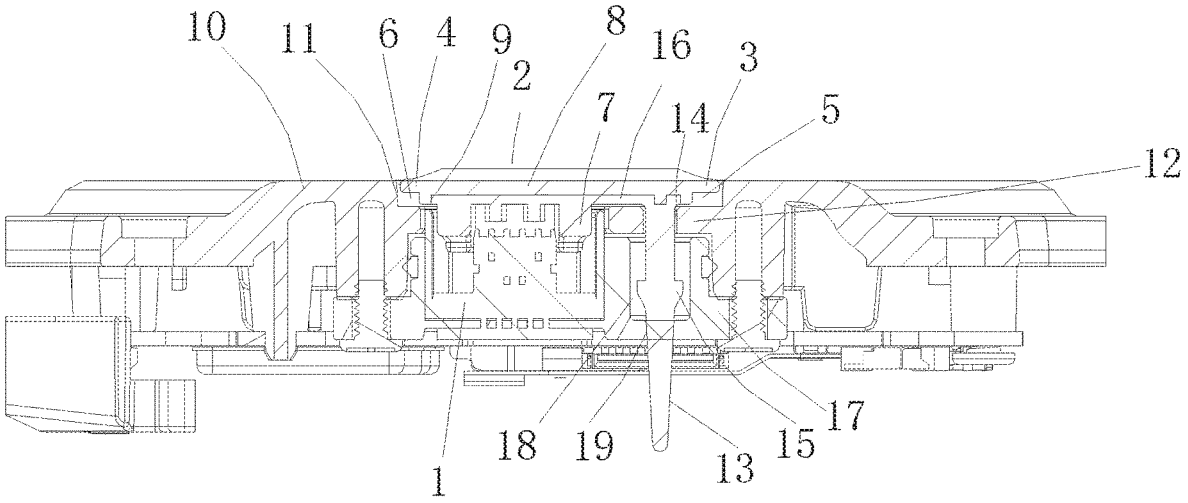
FIG. 3 is a cross-sectional view taken along a line A-A in FIG. 1.

As shown in FIG. 1, FIG. 2, and FIG. 3, a universal serial bus (USB) cover connecting structure of an electronic product of the present invention comprises a USB port 1 and a USB cover 2 covering the USB port. A USB hole 11 is disposed on a case 10 of the electronic product at a place opposite to the USB port 1. The USB cover 2 covers the USB hole 11 on the case 110, and the size and the shape of the USB cover 2 match the size and a shape of the USB hole 11. The USB cover is made of a soft material. The USB port 1 is fixed on a base 17, and the base 17 is secured to the case 10 by screws.

As shown in FIG. 2 and FIG. 3, the USB port 1 is formed with a flat shape, having a long edge and a short edge. A first extending part 3 and a second extending part 4 are disposed on two ends of the USB cover 2 opposite to the short edges of the USB port 1, forming a first gap 5 and a second gap 6 between the first extending part 3, the second extending part 4, and sidewalls of the USB cover 2.

A protrusion 12 having an annular shape is disposed on the USB hole 11, and a width of the protrusion 12 on one side of the first extending part 3 is greater than a width of the protrusion 12 on the other side. An end of the USB cover 2 opposite to the protrusion 12 abuts against the protrusion 12, so that a space is formed between the first gap 5, the second gap 6, and the protrusion 12.

While opening the USB cover 2, the first extending part 3 is pressed by a finger to lift the second extending part 4 up, so that a space allowing insertion of a fingernail is formed between the second extending part 4 and the USB hole 11, therefore the second extending part 4 is dug out and the USB cover 2 can be entirely removed. Therefore, the USB cover can be designed without considering the position occupied by the groove, so that a more beautiful and complete appearance can be applied.

Figure 4:
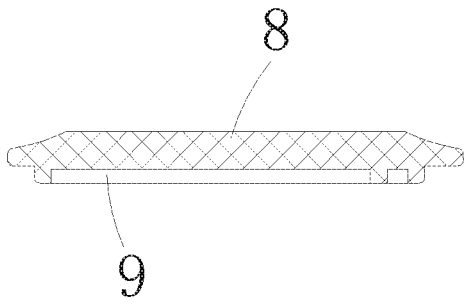
FIG. 4 is a schematic view of a structure of an exterior cover of the present invention.

As shown in FIGS. 2 and 3, the USB cover 2 may comprise an insertion part 7 for inserting into the USB port 1 and an exterior cover 8 exposed above the case, and the first extending part 3 and the second extending part 4 are disposed on the exterior cover 8. A groove 9 (shown in FIG. 4) is disposed on a side of the exterior cover 8 opposite to the insertion part 7, and a side of the insertion part 7 opposite to the exterior cover 8 is inserted into the groove 9 to tightly fit the groove 9, thereby forming a whole component. A columnar connection rod 13 extending along a direction towards the protrusion 12 is disposed on a side of the insertion part 7 opposite to the first extending part, and a socket 14 is disposed on the protrusion 12 at a position opposite to the columnar connection rod 13 inserting into the socket 14. A position limiting block 15 with a diameter greater than the socket 14 is disposed on the columnar connection rod 13, thereby preventing lost and entire removal of the USB cover 2 from the case 10 after being pull out.

Figure 5:
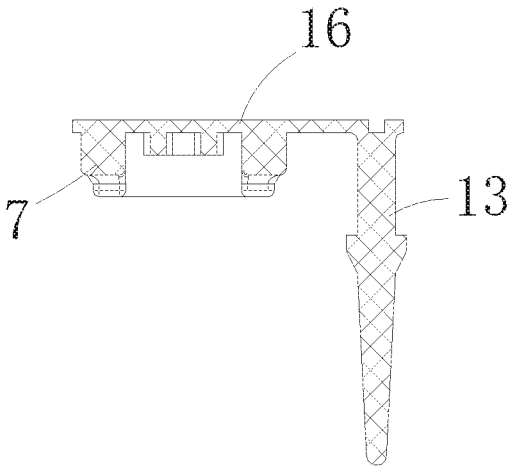
FIG. 5 is a schematic view showing a connection of an insertion part, a columnar connection rod, and a connecting part of the present invention.

As shown in FIG. 5, the USB cover 2 further comprises a connecting part 16 for inserting into the groove 9 provided between the insertion part 7 and the exterior cover 8. The connecting part 16 extends towards the first extending part 3 to secure with the columnar connection rod 13, and the insertion part 7 is secured with the connecting part 16 tightly connecting the groove 9.

As shown in FIG. 3, a first hole 18 allowing penetration of the columnar connection rod 13 is disposed at a position of the base 17 opposite to the columnar connection rod 13, and a second hole 19 connected with the first hole 18 is disposed on the base 17. An aperture of the second hole 19 is smaller than an aperture of the first hole 18, and the columnar connection rod 13 is a tapered shape. An end of the largest diameter is connected and fixed to the connecting part 16, and an end of the smallest diameter of columnar connection rod 13 is inserted into the through hole 18. Thereafter, because the diameter becomes smaller, an exterior wall of the columnar connection rod 13 and the through hole 18 are tightly connected, thereby preventing the USB cover 2 from falling out of the USB hole 11.

The present invention also provides an electronic product comprising the above USB cover connecting structure of the electronic product.

The electronic product of the present invention can be a smart device such as a mobile phone, a smart watch or a smart bracelet.

While the invention has been shown and described with respect to the specific embodiments the embodiments of the embodiments of the invention various changes in details.

What is claimed is:

1. A universal serial bus (USB) cover connecting structure of an electronic product, comprising:

a USB cover, covering a USB port of an electronic product, and disposed on a case of the electronic product, wherein a first extending part and a second extending part are disposed on opposite ends of the USB cover, and a first gap and a second gap are formed between the first extending part, the second extending part, and sidewalls of the USB cover;

wherein a USB hole is disposed on the USB port of the case, and the USB hole is provided with a protrusion having an annular shape, and a width of the protrusion on one side of the first extending part is greater than a width of the protrusion on the other side, and an end of the USB cover opposite to the protrusion abuts against the protrusion, so that a space is formed between the first gap, the second gap, and the protrusion;

wherein a columnar connection rod extending along a direction toward the protrusion is disposed on a side of an insertion part opposite to the first extending part, and a socket is disposed on the protrusion at a position opposite to the columnar connection rod, and the columnar connection rod inserts into the socket; and wherein the USB port is fixed on a base secured to the case by screws, and a first hole allowing penetration of the columnar connection rod is disposed at a position of the base opposite to the columnar connection rod, and a second hole connected with the first hole is disposed on the base, and an aperture of the second hole is smaller than an aperture of the first hole, and the columnar connection rod is tapered shape.

2. The USB cover connecting structure of the electronic product as claimed in claim 1, wherein the USB cover comprises the insertion part for inserting into the USB port and an exterior cover exposed above the case, and the first extending part and the second extending part are disposed on the exterior cover.

3. The USB cover connecting structure of the electronic product as claimed in claim 2, wherein a groove is disposed on a side of the exterior cover opposite to the insertion part, and a side of the insertion part opposite to the exterior cover is inserted into the groove to tightly fit the groove.

4. The USB cover connecting structure of the electronic product as claimed in claim 1, wherein a position limiting block with a diameter greater than the socket is disposed on the columnar connection rod.

5. The USB cover connecting structure of the electronic product as claimed in claim 4, wherein the USB cover further comprises a connecting part for inserting into the groove provided between the insertion part and the exterior cover, and the connecting part extends towards the first extending part to secure with the columnar connection rod, and the insertion part is secured with the connecting portion.

6. The USB cover connecting structure of the electronic product as claimed in claim 1, wherein the USB cover is made of soft materials.

7. A USB cover connecting structure of an electronic product, comprising:

a USB cover, covering a USB port of an electronic product, and disposed on a case of the electronic product, wherein a first extending part and a second extending part are disposed on opposite ends of the USB cover, and a first gap and a second gap are formed between the first extending part, the second extending part, and sidewalls of the USB cover;

wherein the USB cover comprises an insertion part for inserting into the USB port and an exterior cover exposed above the case, and the first extending part and the second extending part are disposed on the exterior cover; and wherein a USB hole is disposed on the USB port of the case, and the USB hole is provided with a protrusion having an annular shape, and a width of the protrusion on one side of the first extending part is greater than a width of the protrusion on the other side, and an end of the USB cover opposite to the protrusion abuts against the protrusion, so that a space is formed between the first gap, the second gap, and the protrusion.

8. The USB cover connecting structure of the electronic product as claimed in claim 7, wherein a groove is disposed on a side of the exterior cover opposite to the insertion part, and a side of the insertion part opposite to the exterior cover is inserted into the groove to tightly fit the groove.

9. The USB cover connecting structure of the electronic product as claimed in claim 7, wherein a columnar connection rod extending along a direction toward the protrusion is disposed on a side of an insertion part opposite to the first extending part, and a socket is disposed on the protrusion at a position opposite to the columnar connection rod, and the columnar connection rod inserts into the socket.

10. The USB cover connecting structure of the electronic product as claimed in claim 9, wherein a position limiting block with a diameter greater than the socket is disposed on the columnar connection rod.

11. The USB cover connecting structure of the electronic product as claimed in claim 10, wherein the USB cover further comprises a connecting part for inserting into the groove provided between the insertion part and the exterior cover, and the connecting part extends towards the first extending part to secure with the columnar connection rod, and the insertion part is secured with the connecting portion.

12. The USB cover connecting structure of the electronic product as claimed in claim 7, wherein the USB cover is made of soft materials.

13. An electronic product, comprising:

a USB cover, covering a USB port of the electronic product, and disposed on a case of the electronic product, and a first extending part and a second extending part are disposed on opposite ends of the USB cover, and a first gap and a second gap are formed between the first extending part, the second extending part, and sidewalls of the USB cover, wherein the USB cover comprises an insertion part for inserting into the USB port and an exterior cover exposed above the case, and the first extending part and the second extending part are disposed on the exterior cover; and wherein a USB hole is disposed on the USB port of the case, and the USB hole is provided with a protrusion having an annular shape, and a width of the protrusion on one side of the first extending part is greater than a width of the protrusion on the other side, and an end of the USB cover opposite to the protrusion abuts against the protrusion, so that a space is formed between the first gap, the second gap, and the protrusion.

14. The electronic product as claimed in claim 13, wherein a groove is disposed on a side of the exterior cover opposite to the insertion part, and a side of the insertion part opposite to the exterior cover is inserted into the groove to tightly fit the groove.

15. The electronic product as claimed in claim 13, wherein a columnar connection rod extending along a direction toward the protrusion is disposed on a side of an insertion part opposite to the first extending part, and a socket is disposed on the protrusion at a position opposite to the columnar connection rod, and the columnar connection rod inserts into the socket.

16. The electronic product as claimed in claim 15, wherein a position limiting block with a diameter greater than the socket is disposed on the columnar connection rod.

17. The electronic product as claimed in claim 16, wherein the USB cover further comprises a connecting part for inserting into the groove provided between the insertion part and the exterior cover, and the connecting part extends towards the first extending part to secure with the columnar connection rod, and the insertion part is secured with the connecting portion.

18. The electronic product as claimed in claim 17, wherein the USB cover is made of soft materials.

* * * * *